US008858023B2

(12) United States Patent
Yang

(10) Patent No.: US 8,858,023 B2
(45) Date of Patent: Oct. 14, 2014

(54) LIGHT MIXING LAMP

(75) Inventor: Yi Yang, Shenzhen (CN)

(73) Assignee: Appotronics Corporation Limited, Shenzhen (CN)

( * ) Notice: Subject to any disclaimer, the term of this patent is extended or adjusted under 35 U.S.C. 154(b) by 58 days.

(21) Appl. No.: 13/640,284

(22) PCT Filed: Apr. 7, 2011

(86) PCT No.: PCT/CN2011/072513

§ 371 (c)(1),
(2), (4) Date: Oct. 26, 2012

(87) PCT Pub. No.: WO2011/124140

PCT Pub. Date: Oct. 13, 2011

(65) Prior Publication Data

US 2013/0194798 A1 Aug. 1, 2013

(30) Foreign Application Priority Data

Apr. 8, 2010 (CN) ..... 2010 1 0146802

(51) Int. Cl.

| | |
|---|---|
| ***F21V 1/00*** | (2006.01) |
| ***F21V 5/00*** | (2006.01) |
| *F21Y 101/02* | (2006.01) |
| *F21Y 113/00* | (2006.01) |
| *F21W 131/406* | (2006.01) |
| *F21Y 105/00* | (2006.01) |

(52) U.S. Cl.

CPC ..... *F21V 5/007* (2013.01); *F21Y 2101/02* (2013.01); *F21Y 2113/005* (2013.01); *F21W 2131/406* (2013.01); *F21Y 2105/001* (2013.01)

USPC ..... 362/237; 362/268

(58) Field of Classification Search

USPC ..... 362/237, 268

See application file for complete search history.

(56) References Cited

U.S. PATENT DOCUMENTS

| | | | | |
|---|---|---|---|---|
| 7,213,940 | B1 | 5/2007 | Van De Ven et al. | |
| 2006/0132725 | A1 | 6/2006 | Terada et al. | |
| 2007/0091613 | A1 * | 4/2007 | Lee et al. | 362/326 |
| 2007/0147041 | A1 * | 6/2007 | Shiratsuchi et al. | 362/268 |

(Continued)

FOREIGN PATENT DOCUMENTS

| | | |
|---|---|---|
| CN | 1732403 | 2/2006 |
| CN | 2779448 | 5/2006 |

(Continued)

OTHER PUBLICATIONS

English translation of Yoshi, Illuminating device and projection type image display unit, Feb. 8, 2006 using ProQuest.*

(Continued)

*Primary Examiner* — Evan Dzierzynski
(74) *Attorney, Agent, or Firm* — Chen Yoshimura LLP

(57) ABSTRACT

An light mixing illumination device includes an array (1) of a plurality of solid state light sources, and an array (2) of a plurality of collimating lenses, each collimating lens being aligned with a solid state light source to collimate the light emitted from the solid state light source into a near parallel light; and a pair of first (5) and second (6) fly-eye lenses, wherein the collimated light from the collimating lens array (2) passes through the first and second fly-eye lens successively.

12 Claims, 5 Drawing Sheets

(56) References Cited

U.S. PATENT DOCUMENTS

| | | | | |
|---|---|---|---|---|
| 2007/0253197 | A1 | 11/2007 | Kung et al. | |
| 2009/0168450 | A1* | 7/2009 | Okamoto et al. | 362/559 |
| 2010/0027257 | A1* | 2/2010 | Boonekamp et al. | 362/235 |
| 2010/0027289 | A1* | 2/2010 | Aiki et al. | 362/558 |
| 2010/0165300 | A1 | 7/2010 | Shimaoka et al. | |

FOREIGN PATENT DOCUMENTS

| | | | |
|---|---|---|---|
| CN | 201014341 | Y | 1/2008 |
| CN | 101371070 | | 2/2009 |
| CN | 201851899 | | 6/2011 |
| JP | 2004053949 | | 2/2004 |

OTHER PUBLICATIONS

International Search Report in the parent PCT application No. PCT/CN2011/072513, dated Jul. 14, 2011.

IPRP in the parent PCT application No. PCT/CN2011/072513, dated Jul. 5, 2011.

Chinese Office Action, dated Jun. 6, 2012, in a counterpart Chinese patent application, No. CN 201110086734.2.

Chinese Office Action, dated Dec. 28, 2012, in a counterpart Chinese patent application, No. CN 201110086734.2.

* cited by examiner

LIGHT MIXING LAMP

BACKGROUND OF THE INVENTION

1. Field of the Invention

This invention relates to lighting devices and systems, and in particular, it relates to light mixing devices having uniform output light distribution.

2. Description of the Related Art

Most lighting apparatus using solid state light source (especially light emitting diodes, LED) emits illumination light by mixing several color lights. For stage lighting red(R), green(G), blue(B) LEDs are turned on respectively or together to obtain monochromatic lights or mixed lights. For example, red and green LEDs can be turned on for mixing yellow light; red and blue LEDs can be turned on for mixing purple light; red, blue, and green LEDs can be turned on by certain power proportion to get white light.

Besides, in some special occasions, such as studios or museums, there is a higher requirement for color rendering index. However, white LEDs alone can't provide light with color rendering index higher than 90, so the light-mixing strategy described above is also generally used to get white light with high color rendering index. For example, U.S. Pat. No. 7,213,940 describes a lighting device utilizing a mixture of white LED and red LED to get white light with high color rendering index.

As is well known, illumination light also has requirement for high optical power. In the high power illumination light device described in Chinese patent publication CN201014341Y, multiple LEDs such as white LED are packaged together in an array and placed in the focus of a Fresnel lens to get parallel light beam. The problem is that its thermal management design is difficult because the LEDs are too close to each other and interfere with each other thermally, which limits the further improvement of power.

To solve the issues above, many solutions have been proposed. A commonly used one is to collimate lights and then mix them directly in the far field. As illustrated in FIG. 1, lights from red LEDs and blue LEDs collimated by different collimators respectively are incident on a screen in the far field and mixed on the screen. This solution is simple, however the uniformity of the mixed light is poor and color shadowing is sometimes produced on the screen. Color shadowing refers to different colors appear on the edge of a shadow cast by an object inserted into the light path. The mechanism of color shadowing is illustrated in FIG. 2. In FIG. 2 section A is illuminated by red light source (labeled R) while the blue light from blue light source (labeled B) is blocked by an object inserting in the light path, so section A appears to be red instead of the color mixed by red and blue. Similarly, corresponding colors will appear in other section of the edge. The reason of color shadowing is that color light beams cannot overlap on the far field screen perfectly due to their different spatial positions. What's more important, for different color LEDs, the collimating angles are different due to the different thickness of LED chips, which can cause color rings in the far field. As shown in FIG. 3, a blue ring will appear on the screen when the collimated blue light has a larger collimating angle.

Therefore, conventional solutions can be used in projection lamp or directional lighting apparatus with low demand for color, but cannot meet the requirement for high color quality.

SUMMARY OF THE INVENTION

To solve the various problems of prior art, the present invention is directed to an illumination device for directional lighting, which generates light of better uniformity.

To achieve these and other advantages and in accordance with the purpose of the present invention, as embodied and broadly described, the present invention provides an illumination device mixing different light emitting devices to provide uniform light, which includes: an solid state light source array composed of multiple solid state light sources, and an collimating lens array composed of multiple collimating lenses, each collimating lens being aligned with a solid state light source to collimate the light emitted from the solid state light source into near parallel light. The illumination device further includes a pair of fly-eye lenses, including a first fly-eye lens and a second fly-eye lens, wherein the collimated light emitted from the collimating lens array passes through the first and second fly-eye lens successively before being output from the illumination device.

The illumination device preferably further includes a pair of Fresnel lenses, including a first Fresnel lens and a second Fresnel lens, wherein the first Fresnel lens' focus is close to or overlapped with the second Fresnel lens' focus. The collimated light emitted from the collimating lens array passes through the first and second Fresnel lens, the first and second fly-eye lens successively.

Preferably, the first Fresnel lens and the second Fresnel lens are both assembled by multiple sub Fresnel lenses which have the same focal length.

Preferably, there are multiple arrays of solid state light sources and multiple arrays of collimating lenses, each array of solid state light sources and its corresponding array of collimating lenses are aligned with at least a sub Fresnel lens.

Preferably, an aperture area of the second Fresnel lens is larger than or equal to that of the first Fresnel lens.

Preferably, the ratio of the focal length to the diameter of aperture of the first Fresnel lens ranges from 1.5 to 1.8, while that ratio for the second Fresnel lenses ranges from 0.7 to 1.

Preferably, the ratio of the focal length to the aperture diameter of the sub Fresnel lens of the first Fresnel lens ranges from 1.5 to 1.8, while that ratio for the sub Fresnel lenses of the second Fresnel lens ranges from 0.7 to 1.

Preferably, the illumination device further includes one or more optical mixing rods located between the first Fresnel lens and the second Fresnel lens whose to increase the distance between the focus of the first and second Fresnel lenses, the increase being dependent on the aperture and length of the optical mixing rods; each optical mixing rod is aligned with a pair of sub Fresnel lenses.

Preferably, the ratio of the rod's length to its aperture is greater than 3.

Preferably, one or both lenses of the pair of fly-eye lenses are composed of multiple micro lenses with the same curvature adjoined together.

Preferably, the distance between the pair of fly-eye lenses is adjustable.

Preferably, the illumination device further includes a control system to control or adjust the power of light emitted from the array of solid state light sources or from individual solid state light sources.

Preferably, the illumination device further includes one or a group of light sensors for providing brightness or color information of the output light to the control system.

The present invention provides an illumination device wherein a pair of fly-eye lenses diffuse lights emitted from the collimating lens array. Due to its structure, the illumination device can produce a mixed output light with better uniformity on the exit surface and avoid the issue of color shadowing. Moreover, the illumination device used as the lighting source of a directional lighting apparatus can provide multiple colors modification and high efficiency. Furthermore, the illumination device has simple structure and can be realized easily.

Preferred embodiments of the present invention are described below with reference to the drawings.

DETAILED DESCRIPTION OF THE PREFERRED EMBODIMENTS

In the present invention, multiple solid state light sources are arranged in an array to enhance the optical power of the illumination device. Collimating lenses are utilized to collimate the light emitted from the solid state light source array. Then a pair of fly-eye lenses are utilized to homogenize the output light and adjust its divergence angle. To obtain better uniformity, a pair of Fresnel lenses may be used to change the distribution of light due to its circumferential and radial distribution, and optimum uniformity can be obtained by making use of fly-eye lenses and Fresnel lenses at the same time.

Figure 1:
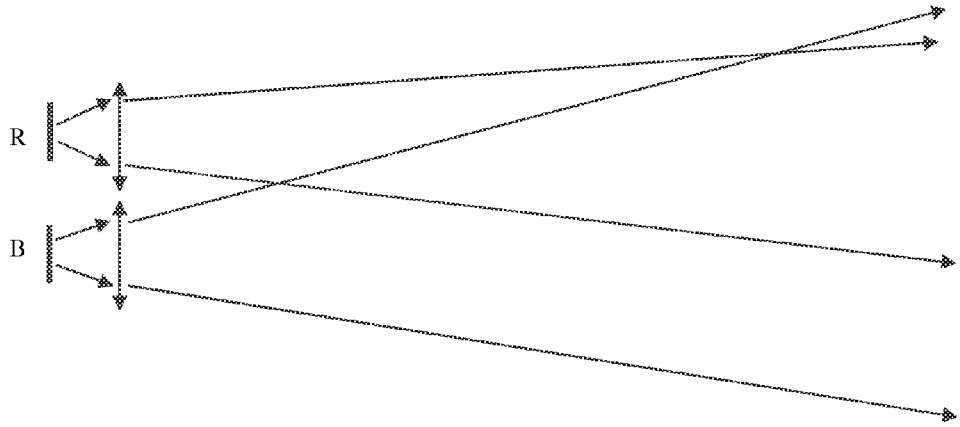
FIG. 1 illustrates the structure of a conventional illumination device mixing different lights.
Figure 2:
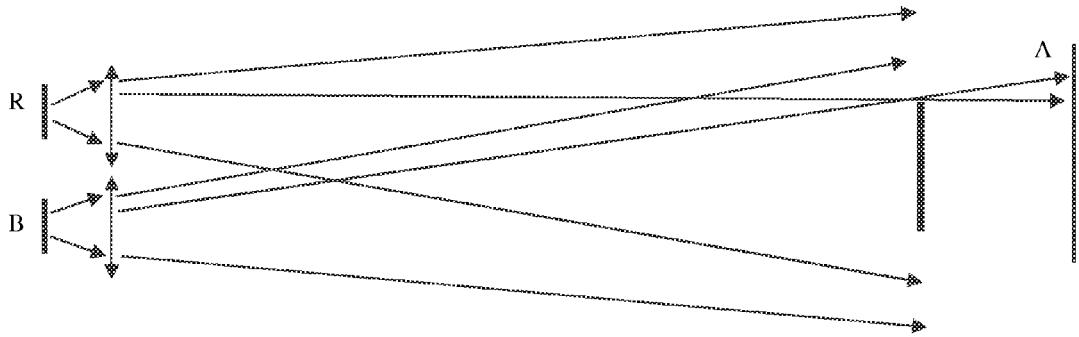
FIG. 2 illustrates the reason why a color ring is caused in the illumination device shown in FIG. 1.
Figure 3:
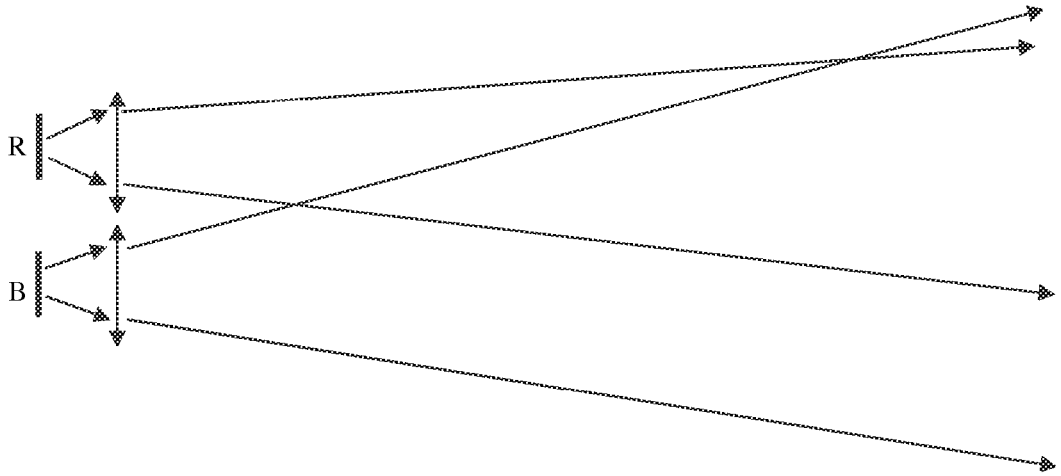
FIG. 3 illustrates the reason why a color shadowing issue is caused in the illumination device shown in FIG. 1.
Figure 4:
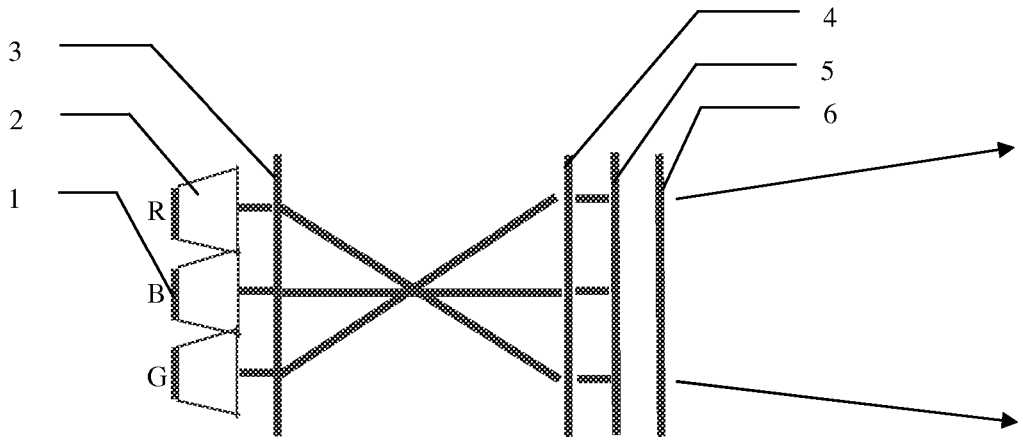
FIG. 4 illustrates the structure of a pair of fly-eye lenses according to an embodiment of the present invention.

FIG. 4 illustrates an illumination device including a solid state light source array 1 composed of multiple solid state light sources, and a collimating lens array 2 composed of multiple collimating lenses, each of which is aligned with a solid state light source to collimate a light emitted from the solid state light source into near parallel light. Furthermore, the illumination device includes a first and a second fly-eye lens 5 and 6 arranged so that the light form the collimating lens array 2 passes the first and second fly-eye lenses 5, 6 successively.

The solid state light source array 1 may include at least two kinds of solid state light sources which are arranged regularly, such as but not limited to solid state semiconductor light sources, like red LEDs, blue LEDs or green LEDs. These light sources emit light of different wavelengths, and are arranged alternatingly to form an array. The LEDs may be a packaged light emitting diode or a light emitting diode chip deposited on a substrate.

For lower cost, the collimating lens array 2 is molded to be one-piece, wherein all collimating lenses are arranged seamlessly based on a transparent substrate. All collimating lenses may be convex lenses with the same focal length, or Fresnel lenses with the same parameters, or self-focusing lenses or compound parabolic concentrators (CPC) with the same parameters. These collimating lenses are aligned with LEDs correspondingly to collimate light emitted from the LEDs as light with divergence half-angle smaller than 30 degree.

Figure 5:
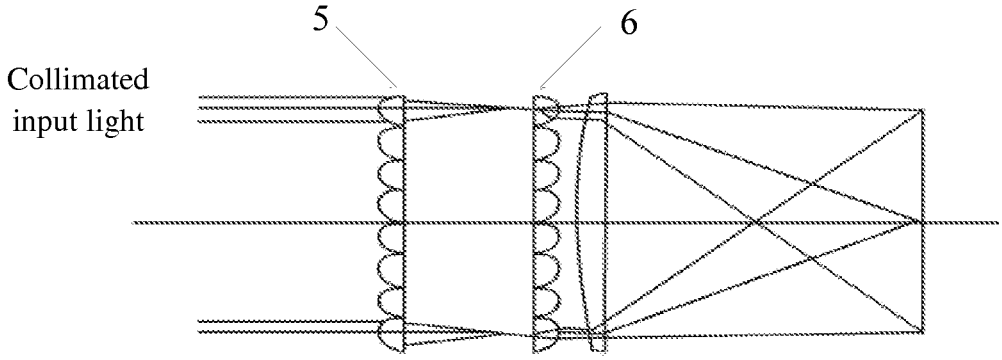
FIG. 5 illustrates an illumination device according to an embodiment of the present invention.

The structure of the pair of fly-eye lenses (5, 6) is shown in FIG. 5. Each fly-eye lens is an array of micro lenses, and these two micro lenses array are arranged correspondingly. The input light is collimated light. Their working process is described as following. Every pair of micro lenses projects their input light to the final screen, so the light on the final screen is the superposition of the output light of all pairs of micro lenses. It can be imagine that, by a pair of fly-eye lenses with ten thousand micro lenses each, collimated input light can be split into ten thousand sub-beams of light. Each sub-beam of light would be projected onto the whole screen, thus the light on the screen is the superposition of the ten thousand sub-beams of light. Even if the input light is not so uniform, the dark part of the input light can only influence the brightness of lights emitted from a small number of micro lens pairs in the fly-eye lenses, and this part of light will be projected and spread on the whole screen, having insignificant effect on uniformity.

As described above, the first and second fly-eye lenses 5 and 6 are arranged face to face, each of which is composed of multiple micro lenses with the same curvature. The fly-eye lenses pair (5, 6) enhances the uniformity of light by splitting the input light into multiple sub-sources and integrating the lights emitted from all the sub-sources. The focal length of the micro lens of the first fly-eye lens 5 may not be equal to that of the second fly-eye lens. Furthermore, the distance between the first and second fly-eye lenses can be adjustable, which can control the angle of output light emitted from the illumination device in the present embodiment.

To solve the color shadowing issue, mixing light in the far field is not enough; instead, a uniform mixing of light should be achieved on the exit surface of the illuminating device. Embodiments of the present invention mix the collimated light from the collimating lens array 2 by using a pair of fly-eye lenses (5, 6) for emitting a more uniform mixed light in the exit surface of the lighting device, which improves the uniformity of the mixed light and avoids the color shadowing issue.

In certain applications, the solid state light array 1 is composed of many LEDs or many LED arrays, so the pair of fly-eye lenses has to be large correspondently which leads to difficulty and cost for manufacture. To solve this problem, the first fly-eye lens 5 and 6 may be respectively obtained by assembling multiple parts which have been fabricated by a molding process.

Figure 6:
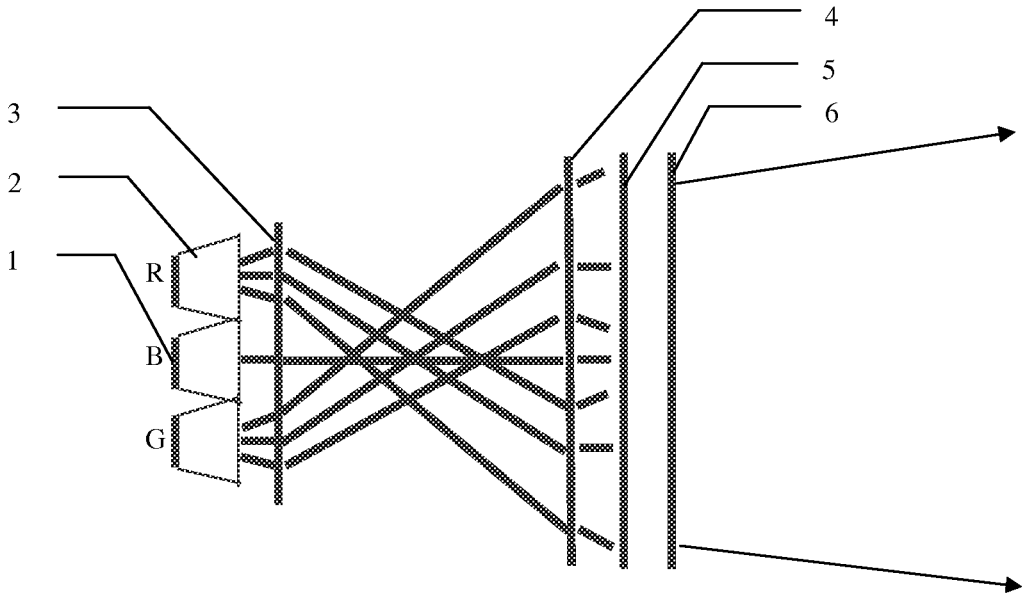
FIG. 6 illustrates an illumination device according to another embodiment of the present invention.

In another application, a pair of Fresnel lenses may be further utilized to improve the uniformity of output light. FIG. 6 shows such an illumination device, wherein the collimated light emitted from the collimating lens array 2 is transmitted through the first Fresnel lens 3, the second Fresnel lens 4, the first fly-eye lens 5 and the second fly-eyes lens 6 successively.

Fresnel lens is a variant of convex lens. It has a rotation-symmetry structure and optical characteristics similar to convex lens which converge parallel light onto a focus point. In the illustrated embodiment, the collimated light is firstly converged by the first Fresnel lens 3, and then collimated again by the second Fresnel lens 4 before passing through the fly-eye lenses pair (5, 6) to obtain a final homogeneous light. As pointed out above, to solve the color shadowing issue, the uniform mixing light has to be performed on the exit surface of the illumination device. In the illustrated embodiment, light is firstly homogenized by the Fresnel lenses (3, 4) around their axis of symmetry in the process of converging and collimating, then diffused by the fly-eye lenses (5, 6) to obtain uniform mixed light on the light exit surface of the illumination device and solve the color shadowing issue thoroughly.

In a one embodiment, the focus of the first Fresnel lens 3 (with focal distance f1) is close to or overlapped with that of the second Fresnel lens 4 (with focal distance f2) to generate the best uniformity and low divergence angle. Furthermore, it is more efficient when the light collecting area of the first Fresnel lens 3 is larger than or equal to the light-emitting surface of the collimating lens array 2. For adjustment of the output light spot size of the illumination device, the light collection area of the second Fresnel lens 4 is preferably larger than or equal to that in the first Fresnel lens. As is shown in the embodiment illustrated in FIG. 6, the light collection area of the second Fresnel lens 4 is preferably larger than or equal to that of the first Fresnel lens 3, which improves the efficiency of lighting device and provides a larger output surface.

To obtain a higher efficiency of lighting device, the focal lengths of the first and second Fresnel lenses (3, 4) can be optimized. Preferably, the ratio of the focal length to the diameter of aperture of the first Fresnel lens ranges from 1.5 to 1.8, while that of the second Fresnel lens ranges from 0.7 to 1, which make the efficiency 10% higher than the case when both Fresnel lenses' focal length are the same as their respective aperture diameter. Under the best optimization, the ratio of the focal length to the aperture diameter of the first Fresnel lens 3 is 1.65, while the ratio of the focal length to the aperture diameter of the second Fresnel lens 4 is 0.85, which makes the efficiency 17% higher than the case when both Fresnel lenses' focal length are the same to their aperture diameter.

Figure 7:
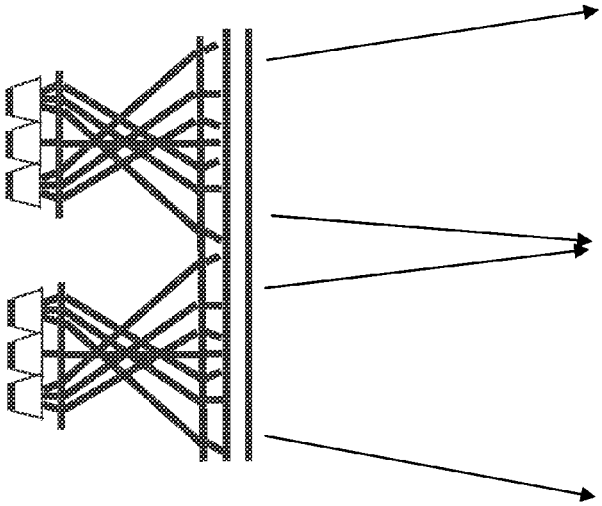
FIG. 7 illustrates an illumination device according to another embodiment of the present invention.

In the situation with a higher requirement for the output power or the size of light output surface of the illumination device, the larger size of light source array make the distance between the first and second Fresnel lenses (3, 4) larger, which result in a larger length of the illumination device. Therefore, as shown in FIG. 7, the illumination device may include multiple (such as but not limited to 2 shown in the figure) solid state light source arrays 1 and corresponding collimating lens arrays 2, and Fresnel lenses pair (3, 4) wherein the first and second Fresnel lens are both assembled respectively by multiple first sub Fresnel lenses with the same focal length f1 and second sub Fresnel lenses with the same focal length f2, in order that each array of solid state light sources and its corresponding array of collimating lenses are aligned with at least a pair of sub Fresnel lenses. Accordingly, the size of each sub Fresnel lens is reduced to 1/n of its original size and the focal length of each small Fresnel lens reduced accordingly. In one embodiment, the ratio of the focal length to the diameter of aperture of the first sub Fresnel lens ranges from 1.5 to 1.8, while that of the second sub Fresnel lenses ranges from 0.7 to 1.

Figure 8:
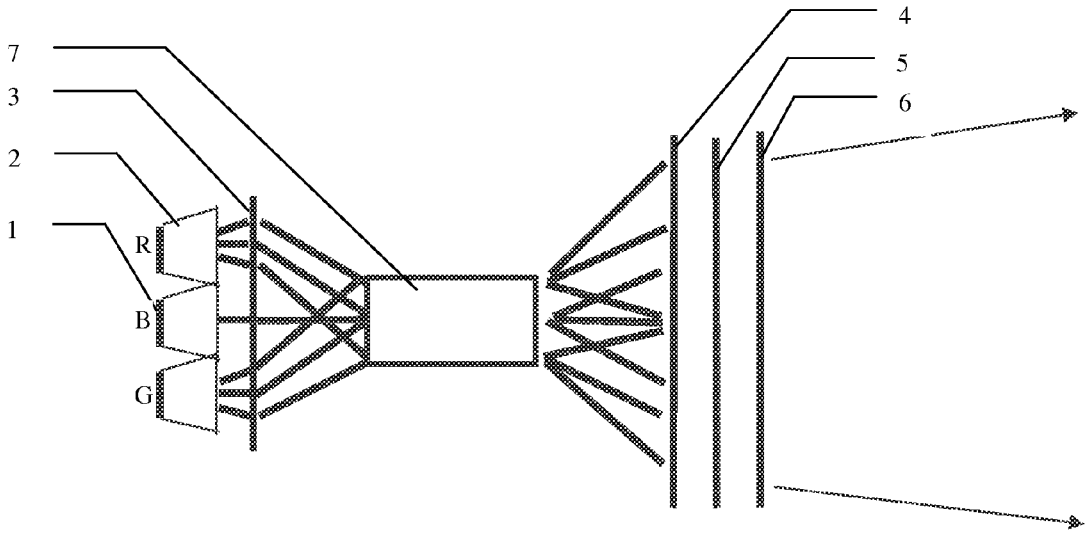
FIG. 8 illustrates an illumination device according to another embodiment of the present invention.

To further improve the uniformity of the output light, the illumination device according to another embodiment of this invention, as shown in FIG. 8, may also include an optical mixing rod 7 located between the first Fresnel lens 3 and the second Fresnel lens 4. Its input side is near the focus point of first Fresnel lens 3 and its output side is near the focus point of the second Fresnel lens 4. Thus, the focus of the first Fresnel lens and that of the second Fresnel lens are now located at a distance from each other. This distance is determined by the relationship between the aperture of the optical mixing rod 7 and the focal distances f1 and f2, as well as the length of the optical mixing rod 7. For optimization of collection performance, the length of the optical mixing rod 7 is at least greater than three times its aperture. In the illumination device wherein each of the Fresnel lens is assembled by multiple sub Fresnel lenses, there should be multiple optical mixing rod 7 each corresponding to a pair of sub Fresnel lenses.

Figure 9:
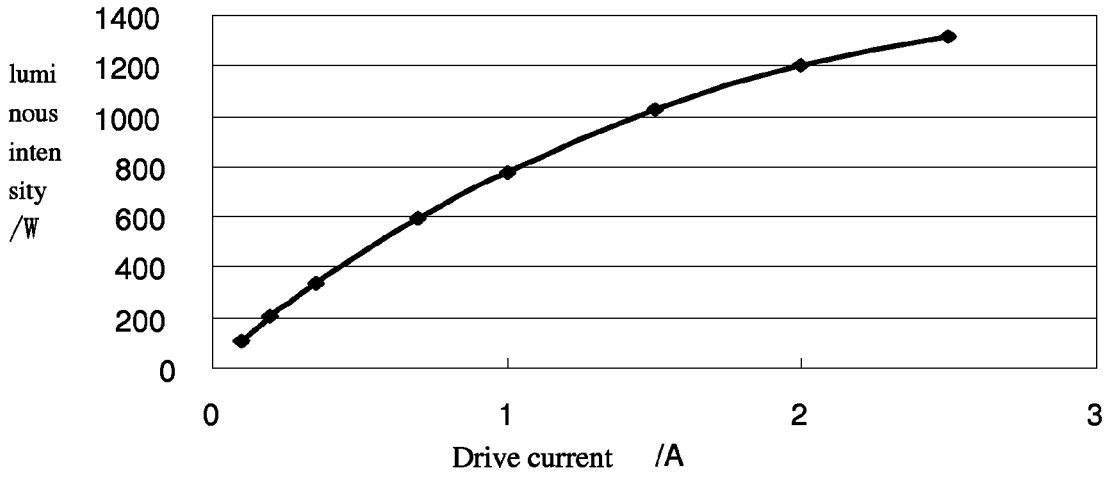
FIG. 9 illustrates the relationship between the luminous intensity and the drive current of an LED.

In another embodiment, the uniformity, brightness or color of the output light of the illumination device can be adjusted by controlling different solid state light sources or different arrays of solid state light sources. For example, the illumination device illustrated in FIG. 7 may further include a control system, which is utilized to control or adjust the output power or luminous intensity of different arrays of solid state light sources by adjusting their drive current. The relationship between the luminous intensity and the drive current of an LED or LED array is shown in FIG. 9. Moreover, the control system may also adjust the luminous intensity of an LED by adjusting the duty cycle of its driving voltage in pulse mode. Thus, the whole output light can be homogenized by controlling different LED arrays in an illumination device with multiple LED arrays. Furthermore, the illumination device may also include one optical sensor or a group of optical sensors utilized to detect the brightness or color of mixed output light in different places of the illumination device and feedback the message to the control system to control the luminous intensity of different LED arrays or LEDs for different spectrums. By this way automatic control of the illumination device can be achieved, which avoids color shift caused by different aging rate of different LEDs, and could conveniently set the color or color adjustment of the illumination device.

It will be apparent to those skilled in the art that various modification and variations can be made in the light source device and system of the present invention without departing from the spirit or scope of the invention. Thus, it is intended that the present invention cover modifications and variations that come within the scope of the appended claims and their equivalents.

What is claimed is:

1. An illumination device, comprising:

an array of a plurality of solid state light sources;

an array of a plurality of collimating lenses, each collimating lens being aligned with a solid state light source to collimate light emitted from the solid state light source into collimated light;

a pair of fly-eye lenses including a first fly-eye lens and a second fly-eye lens, wherein the collimated light from the collimating lens array passes through the first and second fly-eye lenses successively; and a pair of Fresnel lenses including a first Fresnel lens and a second Fresnel lens located between the collimating lenses array and the first fly eye lens, receiving the collimated light from the collimating lens array and transmitting it to the pair of fly-eye lenses, wherein a focus point of the first Fresnel lens is located close to or overlapped with a focus point of the second Fresnel lens.

2. The illumination device of claim 1, wherein each of the first Fresnel lens and the second Fresnel lens is formed by multiple sub Fresnel lenses which have same focal length.

3. The illumination device of claim 2, comprising multiple arrays of solid state light sources and multiple arrays of collimating lenses, each array of solid state light sources and its corresponding array of collimating lenses being aligned with at least one sub Fresnel lens.

4. The illumination device of claim 2, wherein a ratio of focal length to aperture diameter of each first sub Fresnel lens ranges from 1.5 to 1.8, and wherein a ratio of focal length to aperture diameter of each of the second sub Fresnel lens ranges from 0.7 to 1.

5. The illumination device of claim 1, wherein an aperture area of the second Fresnel lens is larger than or equal to an aperture area of the first Fresnel lens.

6. The illumination device of claim 1, wherein a ratio of focal length to diameter of aperture of the first Fresnel lens ranges from 1.5 to 1.8, and wherein a ratio of focal length to diameter of aperture of the second Fresnel lenses ranges from 0.7 to 1.

7. The illumination device of claim 1, further comprising:

at least one optical mixing rod located between the first Fresnel lens and the second Fresnel lens, wherein an input side of the optical mixing rod is located near a focus point of first Fresnel lens and an output side of the optical mixing rod is located near a focus point of the second Fresnel lens, each optical mixing rod being aligned with a pair of sub Fresnel lenses.

8. The illumination device of claim 7, wherein a ratio of length to aperture diameter of an optical mixing rod is larger than 3.

9. The illumination device of claim 1, wherein the first or the second fly-eye lens is formed of multiple micro lenses having a same curvature.

10. The illumination device of claim 1, wherein a distance between the pair of fly-eye lenses is adjustable.

11. The illumination device of claim 1, further comprising:

a control system to control or adjust a power of light emitted from the array of solid state light sources or from individual solid state light sources.

12. The illumination device of claim 11, further comprising:

one or a group of light sensors, for feeding back a brightness or color information of an output light of the illumination system to the control system.

* * * * *